United States Patent [19]

Chung et al.

[11] Patent Number: 4,813,987

[45] Date of Patent: Mar. 21, 1989

[54] PROCESS FOR THE LIQUEFACTION OF NATURAL GAS

[75] Inventors: Harold S. Chung, Princeton, N.J.; Alan J. Silverman, Dallas, Tex.; Tsoung Y. Yan, Philadelphia, Pa.

[73] Assignee: Mobil Oil Corporation, New York, N.Y.

[21] Appl. No.: 107,750

[22] Filed: Oct. 13, 1987

[51] Int. Cl.[4] ..... F25J 5/00

[52] U.S. Cl. ..... 62/12; 55/72; 62/303; 165/95

[58] Field of Search ..... 62/20, 303, 12; 55/72; 165/95

[56] References Cited

U.S. PATENT DOCUMENTS

| | | | |
|---|---|---|---|
| 3,193,987 | 7/1965 | Manes et al. | 55/72 |
| 3,593,535 | 7/1971 | Gaumer Jr. et al. | 62/23 |
| 3,714,979 | 2/1973 | Stevens | 165/95 |
| 3,803,803 | 4/1974 | Raduly et al. | 55/72 |
| 3,818,975 | 6/1974 | Tokumitsu et al. | 165/95 |
| 4,101,631 | 7/1978 | Ambrosini et al. | 55/72 |
| 4,420,317 | 12/1983 | Stewart | 62/20 |
| 4,474,896 | 10/1984 | Chao | 55/74 |
| 4,491,609 | 1/1985 | Degel et al. | 427/215 |
| 4,500,327 | 2/1985 | Nishino et al. | 55/72 |
| 4,589,898 | 5/1986 | Beaver | 165/95 |
| 4,701,212 | 10/1987 | Yan et al. | 75/26 |
| 4,709,118 | 11/1987 | Yan et al. | 585/820 |

OTHER PUBLICATIONS

Geist, et al. "Predicted and Actual Temperature Profiles and Pressure Drops in Large Coil Wound, Mixed Refrigerant Heat Exchangers," LNG-6, Session II, Paper 4, Apr. 7-10, 1980 Kyoto, Japan.

*Primary Examiner*—Ronald C. Capossela
*Attorney, Agent, or Firm*—Alexander J. McKillop; Charles J. Speciale

[57] ABSTRACT

The opportunity for mercury vapor, a common component of natural gas, to form a corrosive amalgam with the aluminum construction material of a cryogenic heat exchanger used in natural gas liquefaction operations is greatly minimized by cooling the mercury-containing gas to a temperature at or below the freezing point of mercury prior to introducing the gas to the heat exchanger.

7 Claims, 1 Drawing Sheet

PROCESS FOR THE LIQUEFACTION OF NATURAL GAS

This invention relates to a process for the liquefaction of natural gas (or other elemental mercury vapor-containing hydrocarbon gas) employing a cryogenic heat exchanger fabricated from aluminum.

BACKGROUND OF THE INVENTION

The liquefaction of natural gas for storage and transportation and regasification for final distribution is a well established technology. Liquefied natural gas (LNG) represents an economically attractive energy option, especially for industrial nations short on domestic fuel reserves.

Several types of natural gas liquefaction processes are known. One conventional LNG process, the standard cascade system, uses three different refrigerants, i.e., methane, ethylene and propane, circulating in closed cycles. One example of such a system is described in U.S. Pat. No. 3,593,535. An improvement over the standard cascade system employs a single-pressure mixed refrigerant cascade (MRC) system. In one version of the MRC system described in Geist et al., "Predicted and Actual Temperature Profiles and Pressure Drops in Large Coil Wound, Mixed Refrigerant Heat Exchangers," LNG6, Session II, Paper 4, April 7–10, 1980, Kyoto, Japan, a natural gas feed following treating and drying is precooled in an auxiliary heat exchanger supplied with propane refrigerant. Thereafter, the chilled gas is introduced into a cryogenic main heat exchanger (MHE) where liquefaction takes place. The MHE is horizontally divided into an upper cold bundle absorbed by propane and a lower warm bundle absorbed by mixed refrigerant.

The industry, in general, is predominantly reliant on propane as a refrigerant. Such reliance poses serious problems, especially from the standpoint of obtaining very low temperatures. It is quite difficult to provide very low temperatures by use of propane. Propane as a refrigerant is limited by its boiling point at a workable pressure of about 20 psi.

Regardless of the liquefaction system used, aluminum is often the material of choice for the construction of the cryogenic heat exchanger due to its high thermal conductivity, excellent low temperature properties, machinability and relatively low cost. However, aluminum is susceptible to corrosion by the mercury which is present in natural gas, e.g., from as low as about 0.005 to as high as about 200 micrograms per normal cubic meter (i.e., from about $5.5\times10^{-3}$ to about 220 parts per billion by volume). Concentrations of mercury greater than about 0.01 micrograms per normal cubic meter are generally regarded as undesirable especially where aluminum cryogenic liquefaction equipment is concerned due to mercury's capability for forming a corrosive amalgam with aluminum. This type of amalgamation weakens the aluminum heat exchanger by creating cracks which can ultimately result in explosions of the higher pressure vessels.

Although it is a conventional practice to demercurate natural gas (see, for example, the demercuration processes described in U.S. Pat. Nos. 3,193,987; 3,803,803; 4,101,631; 4,474,896; 4,491,609; 4,474,896; and, 4,500,327), a sufficient amount of mercury will often remain in the post-treated gas as to pose a significant safety and maintenance problem where aluminum cryogenic heat exchangers are concerned. In its solid state, however, i.e., below its point of solidification, mercury does not tend to form an amalgam with aluminum. While this fact might have been considered useful in preventing corrosive mercury-aluminum interaction, the industry's reliance on propane as a refrigerant has until now limited the ability to attain the temperature required to solidify the mercury in mercury-containing natural gas streams.

Thus, it is an object of the present invention to provide a process for the liquefaction of a mercury-containing gas, in particular, natural gas, in aluminum cryogenic equipment in which the corrosion potential of the mercury for the aluminum is lessened or minimized.

It is a particular object of this invention to reduce the corrosion potential of elemental mercury for aluminum cryogenic gas processing equipment by exploiting the observation that at or below its freezing point, mercury exhibits no appreciable tendency to form an amalgam with aluminum, specifically, by introducing the mercury-containing feed gas into the main heat exchanger (MHE) at a temperature at which the mercury is present in the gas in the solid state.

SUMMARY OF THE INVENTION

In accordance with the present invention, in a process for liquefying an elemental mercury vapor-containing gas in a cryogenic heat exchanger, an improvement is provided which includes introducing the gas to a cryogenic heat exchanger which is fabricated from aluminum, the gas at introduction to the heat exchanger being at a temperature at which at least a substantial portion of the mercury content thereof is in the solid state.

In one embodiment of the invention the mercury-containing gas stream can be sequentially cooled after a first precooling step in which the stream is preferably reduced to about −22° C. when the stream is a natural gas stream. The second precooling stage, which can include a reduced size vessel utilizing propane/ethane mixture or propane at a low pressure condition of about 1.0 atmosphere or lower as a refrigerant, preferably reduces the temperature of the gas stream to at least below about −39° C. before introducing the stream into the cryogenic heat exchanger. In this way, the mercury contained in the stream is solidified so that its potential effect on the aluminum heat exchanger is significantly reduced or completely eliminated.

However, in a most preferred embodiment, a small portion of the liquefied gas stream exiting the main cryogenic heat exchanger can be circulated to the mercury-containing stream after it has been precooled. This liquefied gas stream product used to precool can be at a temperature of about −252° C. and at a pressure of about 48 Bar A in the case of liquid natural gas. When a precooling stream at this temperature is used, it has been found that as little as 5% by weight can be added to the mercury-containing stream at about −22° C. to reduce it to a temperature of about −40° C. before entering the main cryogenic heat exchanger. It is evident that this second most preferred embodiment is a highly efficient system which requires minimal additional energy consumption to provide the low temperature required to solidify mercury in the stream.

By maintaining the feed gas at or below the aforesaid temperature, the opportunity of the mercury present in the feed gas to form an amalgam with the aluminum of the heat exchanger and thus cause corrosive failure and/or stress corrosion cracking of the heat exchanger with its attendant safety and maintenance problems is greatly minimized. Furthermore, the present invention enables the practitioner to achieve the required low temperature by use of existing propane cooling systems without the need for redesign or use of expensive refrigerants.

DESCRIPTION OF THE PREFERRED EMBODIMENTS

Figure 1:
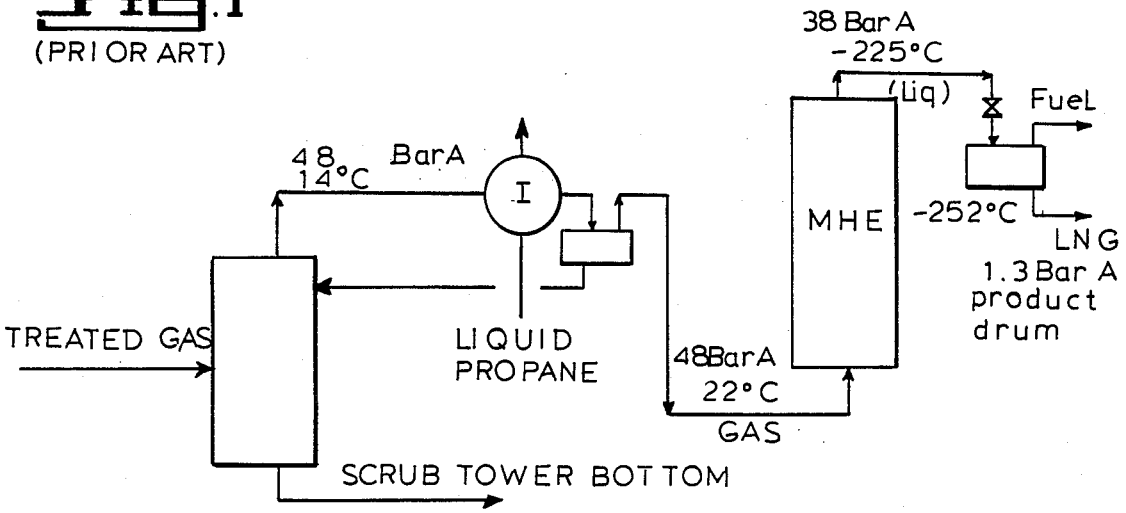
Fig. 1 (PRIOR ART)
FIG. 1 is provided for comparison purposes and is a flow diagram of a known type of natural gas liquefaction system in which an elemental mercury vapor-containing natural gas feed which has been precooled to a temperature of about −22° C. (i.e., a temperature at which the mercury vapor content of the gas remains in the vapor state) is liquefied in a main heat exchanger (MHE) constructed from aluminum.

In the known LNG process illustrated in FIG. 1, treated natural gas (usually characterized as having $H_2S$, $CO_2$, and some Hg vapor removed) containing mercury in the vapor state is introduced into a scrub tower with the overhead gas being taken off at about 48 BarA and 14° C. and introduced into a first precooling heat exchanger I supplied with liquid propane refrigerant. Passage of the gas at pressure through heat exchanger I reduces its temperature to about −22° C., i.e., a temperature at which the elemental mercury present in the original feed gas remains in the vapor stage. A minor portion of the chilled gas is recycled to the top of the scrub tower, the major portion of the gas being introduced to the MHE wherein liquefaction takes place. The LNG product from the MHE, now at 38 BarA and about −225° C., is introduced into the product drum with evaporation of a light fraction which is taken off as a gaseous fuel cooling the remaining LNG to its final storage/transportation temperature of about −252° C.

Figure 2:
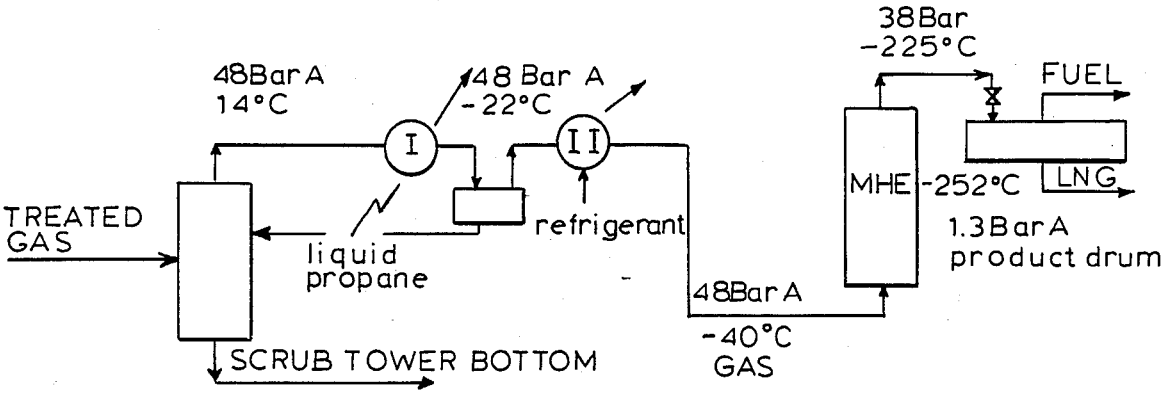
FIG. 2 is a flow diagram of one embodiment of the gas liquefaction process of the present invention in which an elemental mercury vapor-containing natural gas which has been precooled in a series of auxiliary heat exchangers to a temperature of at least about −40° C. (i.e., just below the −39° C. freezing point of mercury) is introduced into an aluminum MHE where liquefaction of the gas to LNG takes place; and, FIG. 3 is a flow diagram of another embodiment of the gas liquefaction process of the present invention featuring recycle of a portion of the LNG to precool the feed gas to the MHE to about −40° C.

In contrast to the foregoing known liquefaction operation, FIG. 2 illustrates an embodiment of the process of the present invention in which the major portion of the precooled gas emerging from first stage precooling heat exchanger I is passed through a second stage precooling heat exchanger II which results in further cooling of the gas to a temperature which is at or below, and preferably just below, the freezing point of mercury which is −39° C. whereby at least a substantial proportion of the mercury vapor content of the gas will condense to the solid state. So, for example, at a temperature of about −40° C., the gas will enter the MHE which is fabricated from aluminum and emerge therefrom in the liquid state at about −225° C. just as in the known LNG process of FIG. 1. However, since the mercury content of the gas introduced to the MHE is in the solid state, it has little, if any, opportunity to form a corrosive amalgam with the aluminum from which the MHE is constructed. The second precooling heat exchanger II can be a small device, which is simple in construction. Hence, the second precooler can be readily fabricated from stainless steel which is not susceptible to amalgamation with mercury.

Figure 3:
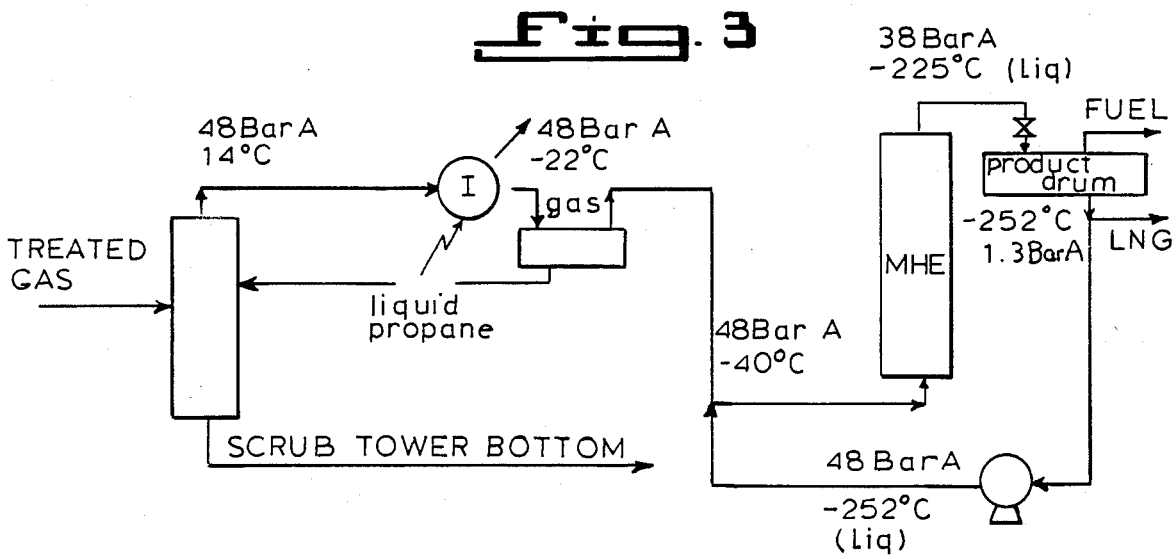

The schematic LNG operation illustrated in FIG. 3 shows another embodiment of the present invention, this time involving recycle of a part of the LNG emerging from the MHE to further cool the gas passing from precooling heat exchanger I to a temperature of about −40° C. and thus condense at least a substantial proportion of the mercury vapor content of the MHE feed to the solid state. This embodiment of the invention may be the most preferred inasmuch as it involves minimum modification of existing gas plant equipment and can be implemented at little added expense.

Furthermore with regard to this most preferred method, it has been found that, in the case of natural gas, as little as 5% and lower by weight can be added to the mercury-containing stream to provide the precooling required to lower the temperature of the stream to below −39° C. For example, in one system, it was found that 7.38 lbs. of liquefied natural gas product need be added to 100 lbs of fresh feed to sufficiently reduce the temperature after the first precooling stage.

Thus, while there have been described what are presently believed to be the preferred embodiments of the present invention, those skilled in the art will realize that other and further modifications can be made without departing from the spirit of the invention, and it is intended to claim all such changes and modifications as fall within the true scope of the invention.

What is claimed is:

1. In a process for liquefying a mercury vapor-containing gas in an aluminum cryogenic heat exchanger, the improvement which comprises reducing the temperature of said gas to a temperature at which at least a substantial portion of the mercury content thereof is in the solid state and introducing said gas containing said solidified mercury to said aluminum cryogenic heat exchanger.

2. The process of claim 1 wherein said gas is a natural gas.

3. The process of claim 1 wherein said temperature of said gas when introduced to said aluminum cryogenic heat exchanger is at most about −40° C.

4. The process of claim 1 wherein said gas is introduced into said aluminum cryogenic heat exchanger at a temperature of at most about −40° C. following the passage of said gas through at least a second precooling heat exchanger after precooling said gas to a temperature of about −20° C.

5. The process of claim 1 wherein said gas is introduced into said aluminum cryogenic heat exchanger at a temperature of at least about −40° C. following precooling of said gas with product liquified gas.

6. The process of claim 5 wherein said liquefied gas product is mixed directly with said gas after a first precooling to a temperature of about −20° C.

7. The process of claim 1 including the step of mixing gas cooled by said aluminum cryogenic heat exchanger with said mercury vapor-containing gas prior to the introduction of said mercury vapor-containing gas into said aluminum cryogenic heat exchanger.

* * * * *